United States Patent [19]

Erdmann et al.

[11] 4,132,398

[45] Jan. 2, 1979

[54] APPARATUS FOR REMOVING SHEETS FROM STACKS

[75] Inventors: Otto Erdmann, Hamburg; Reinhard Deutsch, Geesthacht; Horst Symmanek, Neubörnsen; Willy Rudszinat, Dassendorf, all of Fed. Rep. of Germany

[73] Assignee: Hauni-Werke Körber & Co. KG., Fed. Rep. of Germany

[21] Appl. No.: 795,563

[22] Filed: May 10, 1977

[30] Foreign Application Priority Data

May 22, 1976 [DE] Fed. Rep. of Germany ..... 2623125
Jan. 24, 1977 [DE] Fed. Rep. of Germany ..... 2702797

[51] Int. Cl.[2] ..... B65H 3/10; B65H 3/44

[52] U.S. Cl. ..... 271/9; 271/12; 271/95; 271/101; 271/104

[58] Field of Search ..... 271/95, 105, 99, 100, 271/101, 104, 106, 107, 9, 11, 12, 13, 14, 15

[56] References Cited

U.S. PATENT DOCUMENTS

| | | | |
|---|---|---|---|
| 1,071,928 | 9/1913 | Koerner | 271/101 |
| 1,072,397 | 9/1913 | Koerner | 271/101 |
| 2,812,178 | 11/1957 | Hagren | 271/104 |
| 3,429,570 | 2/1969 | Scully | 271/101 X |
| 3,926,427 | 12/1975 | Moksnes et al. | 271/95 X |

FOREIGN PATENT DOCUMENTS

| | | | |
|---|---|---|---|
| 622076 | 5/1932 | Fed. Rep. of Germany | 271/95 |
| 686927 | 2/1953 | United Kingdom | 271/101 |
| 897056 | 5/1962 | United Kingdom | 271/95 |

*Primary Examiner*—Bruce H. Stoner, Jr.
*Attorney, Agent, or Firm*—Peter K. Kontler

[57] ABSTRACT

Apparatus for alternately withdrawing lowermost sheets from stacks of sheets in two magazines has a frame which is reciprocable below the magazines along a horizontal path between two end positions and carries a main support, two auxiliary supports which flank the main support, and a suction wheel between the main support and each auxiliary support. The suction wheels are driven in phase with the movement of the frame whereby the wheels turn clockwise while the frame moves in one direction and anticlockwise while the frame moves in the opposite direction. Two toothed belts have end portions which are anchored in a tensioning device between the magazines, and the belts are trained over pulleys of the suction wheels and pulleys of rollers constituting the main support. One suction wheel attracts one edge portion of the lowermost sheet in one of the magazines, the main support is located below such lowermost sheet, and one auxiliary support is located below the lowermost sheet in the other magazine when the frame assumes one of its end positions. When the frame thereupon moves toward the other end position, the one wheel peels the lowermost sheet off the adjacent sheet while the main support moves below the lowermost sheet in the other magazine and the other auxiliary support moves below the fresh lowermost sheet in the one magazine.

21 Claims, 8 Drawing Figures

APPARATUS FOR REMOVING SHEETS FROM STACKS

BACKGROUND OF THE INVENTION

The present invention relates to apparatus for removing sheets or the like from stacks, and more particularly to improvements in apparatus for removing successive lowermost sheets from one or more stacks of superimposed sheets. Stacks which can be converted into a succession of discrete sheets in the apparatus of the present invention may constitute piles of superimposed labels, wrapper blanks or other flexible sheet-like commodities of the type utilized in the tobacco processing industry, e.g., for the making of packs which contain plain or filter-tipped cigarettes, cigars or cigarillos, cheroots, chewing tobacco, pipe tobacco or other smokers' products.

U.S. Pat. No. 3,495,820 granted Feb. 17, 1970 to Seragnoli discloses a sheet removing apparatus wherein a plate-like support is reciprocable along the underside of the lowermost sheet in a stack together with a suction roll which is driven while it moves with the support to peel the lowermost sheet off the underside of the next-to-the-lowermost sheet during movement transversely of the stack. The roll attracts one marginal portion of the lowermost sheet and coils the lowermost sheet around its periphery during movement toward the other marginal portion. The topmost portion or apex of the roll is located at the level of the upper side of the support, i.e., the plane of the upper side of the support is tangential to the peripheral surface of the roll.

It has been found that such apparatus will operate satisfactorily as long as the rate of removal of sheets is below a certain limit. If the rate increases, the apparatus is likely to remove two or more sheets at a time, mainly because the neighboring sheets adhere to each other with a substantial force, especially if the surfaces of the sheets are smooth.

OBJECTS AND SUMMARY OF THE INVENTION

An object of the invention is to provide an apparatus which constitutes an improvement over the apparatus of U.S. Pat. No. 3,495,820 in that it is capable of reliably removing discrete sheets from the underside of a single stack or from the undersides of a plurality of stacks at a frequency which greatly exceeds the frequency of sheet removal by means of conventional apparatus.

Another object of the invention is to provide a high-speed sheet removing apparatus which can be used as a superior substitute for presently known sheet removing apparatus, which can remove sheets from one or more stacks without any defacing, crimping, creasing of and/or other damage to the sheets, and which does not affect the accuracy of alignment of sheets in the stack or stacks during removal of successive lowermost sheets.

A further object of the invention is to provide the apparatus with novel and improved means for effecting a preliminary partial separation of neighboring sheets preparatory to removal of successive lowermost sheets from one or more stacks.

An additional object of the invention is to provide an apparatus which can be used for removal of sheets from a single stack or from a plurality of stacks without any changes in its construction and/or mode of operation.

An ancillary object of the invention is to provide the apparatus with novel and improved separating devices for edge portions of sheets in one or more stacks.

The invention is embodied in an apparatus for removing successive lowermost sheets from a stack of superimposed sheets, particularly for feeding discrete sheets from a stack of sheets to a cigarette packing or other tobacco processing machine. The apparatus comprises a main support having a top surface disposed at a first level below the lowermost sheet of the stack, rotary withdrawing means adjacent to the support and having at least one topmost portion or apex located at a second level which is different from the first level (the second level is preferably located below the first level), a frame or analogous means for transporting the support and the withdrawing means along a predetermined path transversely of the stack (the frame is preferably reciprocable along a straight horizontal path between two spaced-apart end positions), and means for rotating the withdrawing means in phase with movement of the support along the path. The withdrawing means includes at least one suction wheel or analogous means for attracting the lowermost sheet and for peeling the thus attracted sheet off the sheet immediately thereabove during movement of the withdrawing means and the support along the path and during simultaneous rotation of the withdrawing means. The withdrawing means preferably comprises two discrete rotary suction wheels or analogous withdrawing and attracting devices one of which is located ahead of the support and the other of which is located behind the support, as considered in the direction of movement of the frame along the predetermined path. The support preferably comprises a row of parallel rollers whose axes are normal to the direction of movement of the frame. The apparatus further comprises one or more flexible elements which synchronize the movements of the frame with angular movements of the rotary withdrawing devices; the flexible elements are preferably toothed belts which have stationary portions and are trained over toothed pulleys of the withdrawing devices and of the rollers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4:
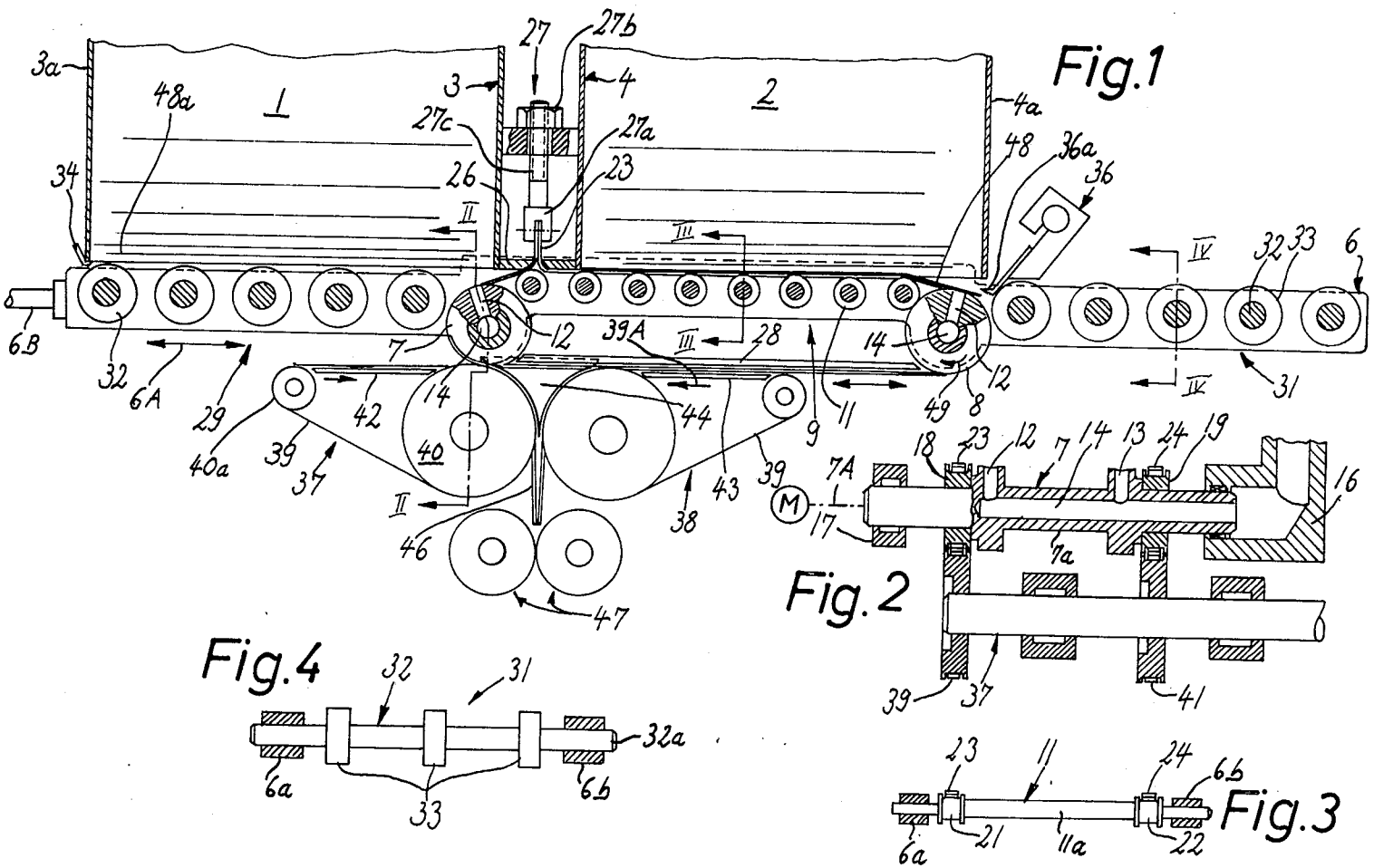
FIG. 1 is a somewhat schematic longitudinal vertical sectional view of an apparatus which embodies one form of the invention and is designed to alternately remove successive lowermost sheets from two neighboring stacks.
FIG. 2 is a sectional view as seen in the direction of arrows from the line II—II of FIG. 1.
FIG. 3 is a sectional view as seen in the direction of arrows from the line III—III of FIG. 1.
FIG. 4 is a sectional view as seen in the direction of arrows from the line IV—IV of FIG. 1.

The apparatus of FIG. 1 comprises two upright magazines 3 and 4 which are located side-by-side and respectively contain stacks 1 and 2 each consisting of a plurality of superimposed sheets made of metallic foil, paper, paper which is coated with metallic foil, lightweight cardboard, synthetic plastic sheet material or the like. The lowermost sheet 48 of the stack 2 rests on a main or central support 9 including a row of parallel rollers 11 of the type shown in FIG. 3. The support 9 is flanked by two sheet withdrawing devices 7, 8 each of which constitutes a suction wheel of the type shown in FIG. 2. The rollers 11 and the wheels 7, 8 are mounted in a horizontal transporting carriage or frame 6 which is reciprocable below the stacks 1 and 2 along a horizontal path in directions indicated by double-headed arrow 6A. FIG. 1 merely shows one elongated component of the frame 6 which is located behind the rollers 11 and wheels 7, 8; a similar component is located in front of such rollers and the two components can be secured to each other by one or more traverses or crossheads extending in parallelism with the axes of the rollers 11 and wheels 7, 8. The axes of the wheels 7 and 8 are located at a fixed distance from each other.

In accordance with a feature of the invention, the apices or topmost portions of the rollers 11 are located in a common horizontal plane which is disposed at a level above the common plane of the topmost portions or apices of the wheels 7 and 8. Thus, when the frame 6 assumes the position which is shown in FIG. 1, the underside of the lowermost sheet 48 in the stack 2 is nearer to the rollers 11 than to the suction wheels 7 and 8.

FIG. 2 shows the details of the suction wheel 7. This wheel has two spaced-apart disks provided with suction ports 12, 13 and two spaced-apart toothed pulleys 18, 19 for flexible elements 23, 24 here shown as toothed belts. The ports 12, 13 communicate with an axial bore 14 which is connected to the intake of a suction generating device (e.g., a fan, not shown) by way of a nipple 16. The nipple 16 constitutes a bearing for and sealingly receives one end portion of the shank 7*a* of the suction wheel 7; the other end portion of the shank 7*a* is rotatable in an antifriction bearing 17 which is mounted in another component (not shown) of the frame 6. The suction wheel 8 is preferably identical with the suction wheel 7 of FIG. 2.

The roller 11 of FIG. 3 has a shank 11*a* which is journalled in the components 6*a*, 6*b* of the frame 6 and carries two toothed pulleys 21, 22 for the belts 23, 24. These belts are trained over the entire row of rollers 11 of the main support 9 as well as over the suction wheels 7 and 8. Their end portions extend through a slot in a stationary platen 26 between the magazines 3, 4 and are secured to the vertically movable portion 27*a* of a tensioning device 27. The tensioning of belts 23, 24 can be changed by rotating a nut 27*b* in mesh with an externally threaded bolt 27*c* which carries the portion 27*a*. It will be seen that the underside of the lowermost sheet 48 of the stack 2 in the magazine 4 rests on the upper reaches of the belts 23, 24, i.e., the rollers 11 are not or need not be in direct contact with the sheet 48. The toothed pulleys 18, 19 of the suction wheels 7, 8 (the pulleys 21, 22 of the rollers 11 may but need not be toothed) insure that the belts 23, 24 cannot slip relative to the suction wheels or vice versa. This guarantees that the suction ports 12, 13 of each suction wheel invariably assume predetermined angular positions in each end position of the frame 6. The lower reaches of the belts 23, 24 slide along the underside of a plate-like guide 28 which is secured to or is otherwise reciprocable with the frame 6.

The frame 6 further carries two auxiliary supports 29, 31 which flank the suction wheels 7, 8 and each of which comprises a row of parallel rollers 32. As shown in FIG. 4, each roller 32 has a shank or shaft 32*a* for three spaced-apart disks 33 which can engage the underside of the lowermost sheet in the magazine 3 or 4. The shanks 32 are journalled in the components 6*a*, 6*b* of the frame 6. When the frame 6 assumes the right-hand end position of FIG. 1, the disks 33 of rollers 32 of the left-hand auxiliary support 29 engage the underside of the lowermost sheet of the stack 1 in the magazine 2. When the frame 6 is moved to the left-hand end position, the lowermost sheet of the stack 2 in the magazine 4 is supported by the disks 33 of rollers 32 of the auxiliary support 31. The topmost portions of all disks 33 are coplanar with the topmost portions of rollers 11 or with the upper sides of the upper reaches of belts 23 and 24.

A pivotable edge holder 36 is located adjacent to the right-hand side wall 4*a* of the magazine 4 and is provided with a toothed portion or pallet 36*a* which can engage the underside of the lowermost sheet 48 in the magazine 4. This pallet is withdrawn (by pivoting the holder 36 anticlockwise, as viewed in FIG. 1) at the time when or shortly before the frame 6 reaches the right-hand end position of FIG. 1 so that the ports 12, 13 of the suction wheel 8 can attract the adjacent edge portion of the lowermost sheet 48 before the frame begins to move in a direction to the left. A similar pivotable edge holder 34 is mounted adjacent to the left-hand side wall 3*a* of the magazine 3. The edge holders 34, 36 are pivoted automatically into and from engagement with the adjacent edge portions of lowermost sheets in the magazines 3, 4 in response to movement of the frame 6 below and relative to the stacks 1 and 2.

The lower reaches of the toothed belts 23, 24 cooperate with upper reaches of endless flexible elements or belts 39 and 41 (see FIG. 2) forming part of two belt conveyors 37, 38 disposed at a level below the frame 6. Each of the belt conveyors 37, 38 further comprises a large pulley 40 and a smaller pulley 40*a* for the respective belts 39 and 41. Portions of the larger pulleys 40 are surrounded by the arcuate walls of a funnel-shaped guide 44 wherein the leading edge or leader of a freshly removed sheet 48 or 48*a* descends into a downwardly tapering channel 46 serving as a means for introducing the leader of the sheet into the nip of two continuously driven advancing rolls 47. The upper reaches of the belts 39 and 41 of the conveyors 37, 38 respectively travel above stationary plate-like back supports 42, 43.

The means for reciprocating the frame 6 between the end position of FIG. 1 and the other (left-hand) end position may comprise a toothed rack on one of the components 6*a*, 6*b* and a pinion which is driven by a reversible electric motor in circuit with suitable limit switches which arrest and reverse the motor whenever the frame 6 reaches the one or the other end position. Alternatively, the means for reciprocating the frame 6 may comprise a fluid-operated motor, e.g., a double-acting pneumatic cylinder and piston unit having a piston rod 6B which is attached to the frame 6.

The suction wheel 7 and/or 8 is driven by a reversible electric motor M through the medium of a transmission which is indicated by the phantom line 7A. The motor M is mounted on the frame 6 and its circuit may include suitable limit switches which reverse the direction of rotation of the suction wheels 7 and 8 whenever the frame 6 reaches the one or the other end position.

The operation:

The frame 6 is shown in the right-hand end position in which the upper reaches of the toothed belts 23, 24 above the rollers 11 of the main support 9 engage the underside of the lowermost sheet 48 in the stack 2. The topmost portions of the disks 33 of the idler rollers 32 of the left-hand auxiliary support 29 are located at the level of the upper sides of the upper reaches of the belts 23, 24 and support the underside of the lowermost sheet 48*a* of the stack 1 in the left-hand magazine 3. The suction ports 12, 13 of the wheel 8 communicate with the intake of the suction generating device via axial bore 14 of the shank of the wheel 8, and the pallet 36*a* of the edge holder 36 is held in the retracted position of FIG. 1 so that the ports 12, 13 of the suction wheel 8 attract the right-hand edge portion of the lowermost sheet 48 to the adjacent portions of the upper reaches of the belts 23, 24. If the sheet 48 is not overly porous, its right-hand edge portion is separated from the edge portion of the sheet thereabove. The piston rod 6B thereupon pulls the frame 6 toward the left-hand end position and the transmission 7A rotates the wheel 7 clockwise in phase with the leftward movement of the frame 6 so that the tensional stress upon the belts 23, 24 remains unchanged. The lowermost sheet 48 of the stack 2 is rolled around the wheel 8 (because its right-hand edge portion is still attracted by the ports 12, 13 of the wheel 8) so that the sheet 48 is peeled off the next-to-the-lowermost sheet of the stack 2 and its right-hand edge portion enters between the lower reaches of the belts 23, 24 and the upper reaches of the belts 39, 41 forming part of the right-hand conveyor 38. The conveyors 37, 38 need not be driven but the right-hand belts 39 and 41 move in the direction indicated by the arrow 39A due to frictional engagement with the lower reaches of the belts 23, 24 or with the sheet 48. The ports 12, 13 of the wheel 8 can be automatically disconnected from the intake of the suction generating device not earlier than when the right-hand edge portion of the sheet 48 reaches the upper reaches of the right-hand belts 39 and 41. The manner in which the ports 12, 13 of the suction wheels 7, 8 can be automatically connected with or sealed from the intake of the suction generating device in predetermined angular positions of the respective suction wheels is well known from the art and is not shown in the drawing. For example, the suction wheels 7 and 8 can rotate suitable valve plates having arcuate slots which register with the passages of the respective nipples 16 in predetermined angular positions of the wheels 7, 8 but seal the passages of the respective nipples from the intake of the suction generating device in other angular positions of the respective wheels. The direction in which the suction wheel 8 rotates during leftward movement of the frame 6 is indicated by the arrow 49.

As the frame 6 moves in a direction to the left, the disks 33 of the rollers 32 forming part of the right-hand auxiliary support 31 move below the magazine 4 and support the underside of the next-to-the-lowermost sheet in the stack 2. At the same time, the upper reaches of the belts 23, 24 to the left of the platen 26 begin to take over the function of the auxiliary support 29, i.e., they engage the underside of the lowermost sheet 48*a* in the magazine 3. The suction wheels 7, 8 and the rollers 11 of the main support 9 roll along the toothed inner sides of the belts 23, 24 and these belts do not perform any sliding movement relative to the lowermost sheets 48 and 48*a*, i.e., the length of the right-hand portions of the upper reaches of the belts 23, 24 decreases proportionally with increasing length of the left-hand upper reaches of these belts.

The arrangement is preferably (but need not be) such that the right-hand marginal portion of the sheet 48 reaches the upper reaches of the right-hand belts 39 and 41 when the suction wheel 8 completes one-half of a revolution in the direction indicated by arrow 49. The right-hand edge portion of the sheet 48 is then advanced by the belts 23, 24 (from above) and by the belts 39, 41 (from below) and is deflected by the guide 44 to enter the channel 46 and thereupon the nip of the advancing rolls 47 which move the sheet to a processing station, e.g., to a station in a packing machine for cigarettes or the like if the sheet 48 constitutes a blank which is to be converted into an envelope of a cigarette pack or if the sheet 48 constitutes a revenue label which is to be coated with adhesive prior to application across one end of a finished cigarette pack.

When the frame 6 reaches the left-hand end position, the edge holder 36 is returned to the operative position to engage the underside of the right-hand marginal portion of the lowermost sheet in the magazine 4, and the edge holder 34 is retracted so that the ports 12, 13 of the suction wheel 7 (which is then located below the left-hand portion of the magazine 3) can attract the left-hand edge portion of the lowermost sheet 48*a* of the stack 1. This sheet is thereupon transferred into the nip of the advancing rolls 47 in the same way as described above in connection with the sheet 48 except that the transfer of the leading edge of the sheet 48*a* into and beyond the channel 46 takes place while the piston rod 6B pushes the frame 6 back toward the right-hand end position of FIG. 1. Also, the suction wheel 7 then rotates anticlockwise and its ports 12, 13 cause the left-hand edge portion of the sheet 48*a* to enter between the lower reaches of the toothed belts 23, 24 and the upper reaches of the belts 39, 41 forming part of the left-hand conveyor 37. During rightward movement of the frame 6, the auxiliary support 29 gradually takes over the function of the rollers 11 and belts 23, 24 (i.e., it begins to support a progressively larger portion of the underside of the fresh lowermost sheet of the stack 1) and the rollers 11 and belts 23, 24 take over the function of the right-hand auxiliary support 31 (by supporting from below a progressively larger portion of the fresh lowermost sheet in the magazine 4). The two end positions of the frame 6 are preferably mirror symmetrical to each other with reference to a plane which is normal to the plane of FIG. 1 and includes the axis of the bolt 27*c*.

The apparatus of FIG. 1 can be used or converted for removal of discrete sheets from a single magazine. For example, if the magazine 3 is empty, the apparatus will deliver a sheet into the nip of the advancing rolls 47 in response to each leftward stroke of the frame 6. If the apparatus is designed for removal of sheets from a single magazine (e.g., from the magazine 4 of FIG. 1), the magazine 3, the edge holder 34, the auxiliary support 29 and the conveyor 37 can be omitted. Also, the suction wheel 7 can be replaced with a simple pulley. The apparatus of FIG. 1 is preferred at this time because the advancing rolls 47 receive a sheet during each stroke of the frame 6.

An advantage of supports which consist of or comprise rollers is that the friction between such supports and the undersides of sheets in the magazines 3 and 4 is only a fraction of friction which develops in conventional apparatus wherein the support is a plate. The toothed belts 23 and 24 insure that the leader of each sheet which is advanced by the suction wheel 7 or 8 is positively guided all the way into and beyond the guide 44. The tensioning device 27 is actuated from time to time to compensate for eventual stretching of the belts 23, 24 after extended periods of use. The teeth of these belts and the teeth of pulleys 18, 19 on the suction wheels 7 and 8 insure an accurate synchronization of rotary movements of suction wheels with reciprocatory movements of the frame 6.

Figures 5, 6, 7, 8:
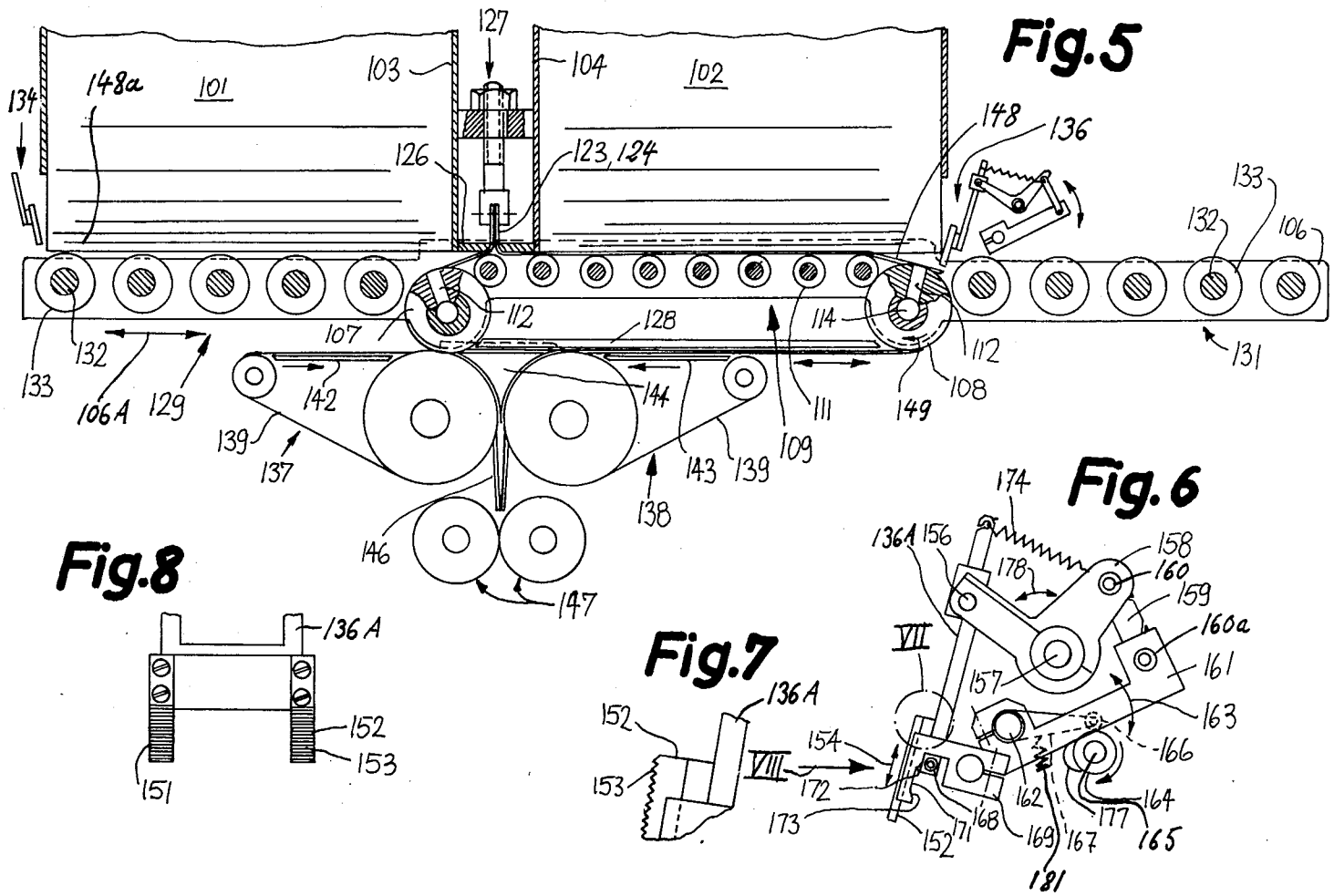
FIG. 5 is a longitudinal vertical sectional view of a second apparatus which is equipped with separating devices for edge portions of sheets in the two stacks.
FIG. 6 is an enlarged elevational view of the right-hand separating device of FIG. 5.
FIG. 7 is an enlarged view of a detail within the phantom-line circle VII of FIG. 6.
FIG. 8 is an end elevational view of a portion of the separating device, substantially as seen in the direction of arrow VIII shown in FIG. 6.

FIG. 5 shows a second apparatus wherein the edge holders 34, 36 are respectively replaced by singularizing or separating devices 134, 136. All such parts (except for the devices 134, 136) of the second apparatus which are identical with or clearly analogous to corresponding parts of the apparatus of FIGS. 1 to 4 are denoted by similar reference characters plus 100. The details of the right-hand separating device 136 are shown in FIGS. 6 to 8. The separating device 134 is preferably identical with and mirror symmetrical to the device 136.

Referring to FIG. 6, the separating device 136 comprises two inclined parallel elongated plate-like singularizing or separating elements 151, 152 (see FIG. 8). These elements are adjacent to and located above the suction wheel 108 when the transporting frame 106 assumes the right-hand end position of FIG. 5. Those surfaces of the separating elements 151, 152 which are adjacent to the right-hand edge portions of sheets in the stack 102 are serrated or roughened (this is shown in FIG. 8, as at 153) whereby the serrations preferably extend in parallelism with the adjacent edge portions of sheets in the magazine 104. The serrated surfaces 153 are suitably inclined, namely, downwardly and inwardly, as viewed in FIGS. 5, 6 or 7, toward the adjacent edge face of the lowermost sheet 148 in the stack 102.

The means for moving the separating elements 151, 152 relative to the stack 102 (in the directions indicated by a double-headed arrow 154) includes an upwardly extending carrier 136A which is articulately connected with one arm of a bell crank lever 158 by a horizontal pivot pin 156. The lever 158 is pivotable about the axis of a stationary shaft 157 and its other arm is coupled to the upper end portion of a link 159 by a pin 160. The lower end portion of the link 159 is coupled to an actuating lever 161 by means of a pin 160*a*, and the lever 161 is pivotable about the axis of a stationary shaft 162 which is parallel to the shaft 157. The directions of oscillatory movement of the actuating lever 161 are indicated by the double-headed arrow 163. The means for oscillating the lever 161 comprises a rotary cam 164 having a lobe 177. The cam 164 is driven by a horizontal shaft 165 and its periphery is tracked by a roller follower 166 which is rotatable on an arm 167 which is rigid with the actuating lever 161 and is turnable about the axis of the shaft 162.

The lower end portion of the carrier 136A is provided with a roller follower 168 which can track a fixedly mounted cam 169. The face of the cam 169 has a drop-off portion 172, a straight portion 171 and a rising portion or ramp 173. The portions 172, 173 are respectively located above and below the straight portion 171. The roller follower 168 is permanently biased against the adjacent portion 171, 172 or 173 by a helical spring 174 which is anchored in the bell crank lever 158 (e.g., on the pin 160) and pulls the upper end portion of the carrier 136A in a clockwise direction, as viewed in FIG. 6. The double-headed arrow 178 indicates the directions of oscillatory movement of the bell crank lever 158.

The operation of the apparatus of FIG. 5 is as follows:

The frame 106 is shown in the right-hand end position, i.e., the lowermost sheet 148 of the stack 102 rests on the upper reaches of the belts 123, 124 and the lowermost sheet 148*a* of the stack 101 rests on the disks 133 of the rollers 132 forming part of the auxiliary support 129. The ports of the right-hand suction wheel 108 (only the port 112 is shown in FIG. 5) attract the right-hand edge portion of the lowermost sheet 148 in the magazine 104. The descent of the right-hand edge portion of the sheet 148 into the range of suction ports in the wheel 108 is effected or assisted by the separating device 136 in the following way:

The shaft 165 drives the cam 164 whose lobe 177 pivots the actuating lever 161 in a counterclockwise direction, as viewed in FIG. 6. The link 159 transmits motion to the bell crank lever 158 which is pivoted anticlockwise, as viewed in FIG. 6, and moves the carrier 136A downwardly. Such downward movement of the carrier 136A is not a simple movement but rather a composite movement which includes a movement toward the suction wheel 108 as well as limited clockwise and anticlockwise pivotal movements about the axis of the pivot pin 156. Thus, as the carrier 136A begins to move downwardly (because the lobe 177 of the rotating cam 164 causes the levers 161 and 158 to pivot anticlockwise), the roller follower 168 travels along the drop-off portion 172 of the cam 169 and moves the serrated surfaces 153 of separating elements 151, 152 nearer to the adjacent edge portions of sheets in the lower part of the stack 102. The serrated surfaces 153 thereby engage the right-hand edge portion of the lowermost sheet 148 and, as a rule, the right-hand edge portion(s) of one or more sheets above the sheet 148. The roller follower 168 thereupon tracks the straight median portion 171 of the cam 169 so that the inclination of the serrated surfaces 153 remains substantially unchanged. However, since the surfaces 153 continue to move downwardly and at an acute angle to the planes of sheets in the magazine 104, their serrations cause a separation of neighboring edge portions from each other and move the right-hand edge portion of the lowermost sheet 148 sufficiently close to the suction wheel 108 to insure that such edge portion is attracted by the ports of the wheel 108 and the lowermost sheet 148 is ready to be peeled or rolled off the sheet thereabove as soon as the frame 106 begins to move toward the left-hand end position. When the roller follower 168 thereupon tracks the ramp 173 of the cam 169, the serrated surfaces 153 move away from the stack 102 (preferably at the very moment when the ports of the suction wheel 108 begin to communicate with the intake of the suction generating device) so that the right-hand edge portion of the lowermost sheet 148 is properly attracted to the adjacent portions of toothed belts 123 and 124. The aforediscussed downward movement of the serrated surfaces 153, while the roller follower 168 tracks the portions 172 and 171 of the cam 169, results in a spreading of edge portions of the lowermost sheets in the magazine 104 (in a manner which might be termed fanwise separation or singularization) so that the tendency of the right-hand edge portion of the sheet 148 to adhere to the underside of the sheet thereabove is reduced or eliminated with the result that the suction wheel 108 attracts only the sheet 148 and transports such sheet into the space between the lower reaches of the belts 123, 124 and the conveyor 138 during movement of the frame 106 toward the left-hand end position.

It is clear that the cam 169 (or at least the ramp 173) can be installed on the frame 106 in the path of downward movement of the roller follower 168 without departing from the spirit of the invention.

Upward movement of the carrier 136A back to the starting position of FIG. 6 can be effected by employing a suitable spring (e.g., a spring 181 which biases the roller follower 166 against the periphery of the cam 164) or by resorting to another cam which pivots the lever 161 and/or the lever 158 clockwise when the lobe 177 of the cam 164 advances beyond the roller follower 166. While the carrier 136A moves upwardly, the serrated surfaces 153 move into temporary contact with the adjacent right-hand edge portions of lowermost sheets in the magazine 104 and return such edge portions to their normal positions (the just mentioned temporary engagement between the sheets and the surfaces 153 takes place while the roller follower 168 travels upwardly along the cam portion 171). When in the starting or upper end position, the carrier 136A maintains the surfaces 153 out of contact with the adjacent sheets of the stack 102 so that such sheets can descend and the lowermost sheet comes to rest on the upper reaches of the belts 123, 124. This insures that the fresh lowermost sheet of the stack 102 is in an optimum position for removal from the magazine 104 by the suction wheel 108 when the frame 106 begins to perform the next leftward stroke.

The left-hand separating device 134 cooperates with the suction wheel 107 when the frame 106 reaches the left-hand end position to insure that the left-hand edge portion of the lowermost sheet **148*a* of the stack 101 invariably adheres to the wheel 107 when the frame 106 begins to move back toward the end position of FIG. 5. Thus, the suction wheel 108 attracts and removes successive sheets from the stack 102 during successive leftward strokes of the frame 106, and the suction wheel 107 attracts and removes successive sheets from the stack 101 during successive rightward strokes of the frame (the same as in the embodiment of FIG. 1). This insures that the machine which processes sheets downstream of the advancing rolls 47 or 147** receives a large number of sheets per unit of time.

The separating devices 134, 136 insure that the suction wheels 107, 108 invariably attract the adjacent edge portions of the lowermost sheets in the respective magazine, regardless of the stiffness or lack of stiffness of sheets which form the stacks 101 and 102. Furthermore, the cams 169 insure that the edge portions of lowermost sheets are sufficiently close to the ports of the respective suction wheels when the frame 106 reaches the one or the other end position. The pairs of elements (151, 152) of each separating device can be replaced with three or more suitably spaced separating elements or with a single separating element which should be sufficiently wide to insure that the edge portions which are engaged by its serrated surface are not twisted or otherwise deformed but are merely moved downward by while the corresponding roller follower 168 tracks the portion 172 and/or 171 of the associated fixed cam 169. By properly selecting the inclination of surfaces 153 relative to the path of movement of the frame 106, one insures that the serrations of such surfaces engage the adjacent edge portion of the lowermost sheet 148 or 148a and perhaps one or more immediately adjacent edge portions. The portions 173 of the cams 169 insure that the serrated surfaces 153 are moved away from the edge portions of the lowermost sheets during the last stage of downward movement of the respective carriers so that the surfaces 153 do not interfere with the attracting action of ports in the suction wheels 107 and 108.

The means for synchronizing the movements of cams 164 of moving means for the separating devices 134, 136 may include photoelectric cells or other suitable detectors which monitor the movements of the frame 106 and/or the angular movements of suction wheels 107, 108 and control the operation of motors for the shafts 165.

An important advantage of the improved apparatus is that the edge portions of successive lowermost sheets are invariably attracted to the belts 23, 24 or 123, 124 when the frame 6 or 106 begins to perform a leftward or rightward stroke. Moreover, the just mentioned edge portions are reliably separated from the edge portions thereabove so that the apparatus removes individual sheets which reduces the likelihood of malfunctioning of the machine or machines wherein the sheets are processed. For example, if the sheets are fed to a cigarette packing machine and the apparatus would fail to advance sheets at required intervals or would advance two or more sheets at a time, it would be necessary to arrest the packing machine at frequent intervals or, at the very least, expel the corresponding groups of cigarettes or unsatisfactory packs with attendant losses in tobacco and output.

Another advantage of the improved apparatus is that removal of successive discrete sheets from one or more stacks takes place without any defacing, creasing or shifting of stacked sheets relative to each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for alternately removing successive lowermost sheets from two stacks of superimposed sheets, particularly for feeding sheets to a tobacco processing machine, comprising a support having a topmost portion disposed at a first level coinciding with the level of the undersides of the lowermost sheets of the stacks; rotary withdrawing means adjacent to said support and having two topmost portions located at a second level below said first level; means for transporting said support and said withdrawing means in unison along a predetermined path transversely of the stacks, said withdrawing means comprising two discrete rotary withdrawing devices one of which is located ahead of and the other of which is located behind said support, as considered in the direction of movement of said support, said devices being supported by said transporting means at a fixed distance from each other and said transporting means including means for moving said support and said devices back and forth in first and second directions; two magazines adjacent to the path of movement of said support, one of said magazines being arranged to store one of said stacks and the other of said magazines being arranged to store the other of said stacks, each of said magazines having an open lower end adjacent said path opposite said support and said withdrawing means and the sheets of each of said stacks having overlapping edge portions, said support and said devices being movable to and from a first end position in which one of said devices is adjacent to the edge portion of the lowermost sheet of the stack in said one magazine and to and from a second end position in which the other of said devices is adjacent to the edge portion of the lowermost sheet of the stack in said other magazine; means for separating said edge portion of the lowermost sheet in each of said magazines from the edge portions thereabove; and means for rotating said withdrawing devices in phase with the movement of said support along said path, each of said withdrawing devices including means for attracting the lowermost sheet of a different stack and for peeling the thus attracted sheet off the sheet immediately thereabove during movement of said withdrawing devices and said support along said path and during simultaneous rotation of said withdrawing devices, said rotating means comprising means for respectively rotating said devices clockwise and counterclockwise during movement of said support in said first and second directions.

2. Apparatus as defined in claim 1, wherein said support comprises a row of parallel rollers.

3. Apparatus as defined in claim 2, further comprising means for synchronizing the movement of said support along said path with rotary movement of said withdrawing devices, including flexible elements trained over said rollers and said withdrawing devices and having stationary portions.

4. Apparatus as defined in claim 3, further comprising means for tensioning said flexible elements, including means for supporting said stationary portions.

5. Apparatus as defined in claim 3, wherein said flexible elements are toothed belts, said rollers and said withdrawing devices having toothed portions mating with the respective belts.

6. Apparatus as defined in claim 3, wherein said stationary portions of said flexible elements disposed between said magazines.

7. Apparatus as defined in claim 1, further comprising two auxiliary supports movable with said first mentioned support along said path, one of said withdrawing devices including a first rotary sheet attracting device located intermediate said first mentioned support and one of said auxiliary supports and the other of said withdrawing devices including a second rotary sheet attracting device located intermediate said first mentioned support and the other of said auxiliary supports, said transporting means including means for reciprocating said supports and said withdrawing devices between said two end positions in one of which said first mentioned support is located below one of the stacks and one of said auxiliary supports is located below the other stack and in the other of which said first mentioned support is located below the other stack and the other auxiliary support is located below the one stack.

8. Apparatus as defined in claim 7, wherein each of said auxiliary supports comprises a row of parallel rollers whose axes are normal to the direction of movement of said supports and said withdrawing devices along said path.

9. Apparatus as defined in claim 1, wherein said means for moving said support and said devices back and forth comprises a reciprocable frame for said support and said withdrawing devices.

10. Apparatus as defined in claim 1, wherein said support comprises a row of parallel rollers whose axes are normal to the direction of movement of said support and said withdrawing devices along said path, and further comprising means for synchronizng the movement of said support with the rotary movement of said withdrawing devices including flexible elements trained over said rollers and said withdrawing devices and having stationary portions, and conveyor means adjacent to said flexible elements and arranged to receive and advance a sheet which is peeled off the sheet thereabove while said support and said withdrawing devices move transversely of the respective stack.

11. Apparatus as defined in claim 10, wherein said conveyor comprises at least one endless flexible element having a portion adjacent to and receiving motion from said first mentioned flexible elements.

12. Apparatus as defined in claim 1, wherein each of said separating means comprises at least one separating element and means for moving said separating element against the edge portion of the respective lowermost sheet in a direction to move such edge portion away from the edge portion thereabove and nearer to the corresponding withdrawing device in the respective end position of said support and said withdrawing devices.

13. Apparatus as defined in claim 12, wherein each of said separating elements has a roughened surface which engages at least the edge portion of the lowermost sheet of the respective stack during said movement of the respective last mentioned moving means.

14. Apparatus as defined in claim 13, wherein said surface is a serrated surface whose serrations are substantially parallel to said edge portions.

15. Apparatus as defined in claim 12, wherein each of said separating means comprises a plurality of spaced-apart separating elements.

16. Apparatus as defined in claim 12, wherein each of said moving means includes means for moving the respective separating element along a second path which makes an oblique angle with the direction of movement of said support along said first mentioned path.

17. Apparatus as defined in claim 16 wherein, during movement along the respective second path and toward the corresponding withdrawing device, each separating element moves nearer to the lowermost sheet of the stack in the respective magazine.

18. Apparatus as defined in claim 12, wherein each of said moving means for said separating elements includes means for imparting to the respective separating element a composite movement including a movement toward the corresponding edge portions and a movement transversely of such edge portions.

19. Apparatus for removing successive lowermost sheets from a stack of superimposed sheets which is confined in a magazine having an open lower end and wherein the sheets of the stack have overlapping edge portions, particularly for feeding sheets to a tobacco processing machine, comprising a support having a topmost portion disposed at a first level below the lowermost sheet of the stack opposite said lower end of said magazine; rotary withdrawing means adjacent to said support opposite said lower end of said magazine and having at least one topmost portion located at a second level which is different from said first level; means for transporting said support and said withdrawing means in unison along a predetermined path transversely of the stack, said path being adjacent to said open end of said magazine and said support and said withdrawing means being movable to and from an end position in which said withdrawing means is adjacent to the edge portion of the lowermost sheet of the stack in said magazine; means for rotating said withdrawing means in phase with the movement of said support along said path, said withdrawing means including means for attracting the lowermost sheet and for peeling the thus attracted sheet off the sheet immediately thereabove during movement of said withdrawing means and said support along said path and during simultaneous rotation of said withdrawing means; and means for separating the edge portion of the lowermost sheet from the edge portions thereabove, including at least one separating element, a carrier for said separating element and means for moving said separating element against the edge portion of the lowermost sheet in a direction to move such edge portion away from the edge portion thereabove and nearer to said withdrawing means in said end position of said support and said withdrawing means, said means for moving said separating element including a first lever pivotable about a fixed axis and having an arm articulately connected with said carrier, a second lever pivotable about a second fixed axis, means for articulately connecting said levers to each other and cam means actuatable to pivot said second lever.

20. Apparatus as defined in claim 19, wherein said moving means further comprises second cam means and said carrier comprises follower means tracking said second cam means while said carrier means moves in response to pivoting of said levers.

21. Apparatus as defined in claim 20, wherein said second cam means is stationary and includes a first portion which causes said follower means to move said element against at least the edge portion of the lowermost sheet in said magazine and a second portion which causes said follower means to disengage said element from such edge portion.

* * * * *